United States Patent [19]

Horn et al.

[11] Patent Number: 4,519,185

[45] Date of Patent: May 28, 1985

[54] DEVICE FOR DEFLECTION OF A CONTINUOUS FILM WEB IN A PACKAGING MACHINE

[75] Inventors: Roland Horn, Frickenhausen; Erhardt Glausch, Nürtingen-Neckarhausen, both of Fed. Rep. of Germany

[73] Assignee: Beck & Co., Packautomaten, Fed. Rep. of Germany

[21] Appl. No.: 391,648

[22] Filed: Jun. 24, 1982

[30] Foreign Application Priority Data

Jun. 27, 1981 [DE] Fed. Rep. of Germany ..... 3125353
Dec. 31, 1981 [DE] Fed. Rep. of Germany ..... 3152023

[51] Int. Cl.[3] ..... B65B 9/06

[52] U.S. Cl. ..... 53/550; 53/568; 493/302

[58] Field of Search ..... 53/550, 568, 201; 493/302, 248, 439

[56] References Cited

U.S. PATENT DOCUMENTS 3,581,461 6/1971 McDurmont ..... 53/568
3,732,789 5/1973 Hartleib ..... 493/302
4,185,443 1/1980 Budzyn ..... 53/550
4,285,686 8/1981 Ambler ..... 493/439

FOREIGN PATENT DOCUMENTS 2519144 11/1976 Fed. Rep. of Germany .
2658166 7/1978 Fed. Rep. of Germany .

*Primary Examiner*—John Sipos
*Assistant Examiner*—Donald R. Studebaker
*Attorney, Agent, or Firm*—Stephenson and Boller

[57] ABSTRACT

In order to realize a device for the deflection of a continuous film web folded in its axial midline in a packaging machine for wrapping a number of sequentially fed objects in which the two film web halves, making flat contact with each other, are fed in a vertical plane located parallel to the feed direction of the objects and are separated in a roof-like manner along a ridge edge extending parallel to the feed direction—and in order to obtain an adaptation to objects of different size vertical to the feed plane on the edges of a guide extending parallel to the feed direction, it is proposed that the guide comprise two guide rails parallel to the feed direction which are inserted opposite to the feed direction into the space between the two roof areas and the top layer and which by their free ends define the lower corners of the triangular area, and that the spacing of the guide rails as well as the vertical distance between the guide elements defining the ridge edge and the guide rails are adjustable.

27 Claims, 9 Drawing Figures

DEVICE FOR DEFLECTION OF A CONTINUOUS FILM WEB IN A PACKAGING MACHINE

The invention concerns a device for the deflection of a continuous film web folded along its axial midline in a packaging machine for the purpose of packaging a number of sequentially fed objects as described in the Main Clause of Claim 1.

In devices of this nature, objects fed sequentially along a horizontal feed plane are enveloped in a continuous film web in tubular form. In order to prevent interference with the feed of the objects, the film is fed essentially vertically from the top to the feed plane. For this purpose, the film is folded along its axial midline, so that the two film web halves contact each other on their faces. Above the objects to be wrapped, the two halves are separated in roof-like fashion and guided vertically downward along the sides of the objects to be wrapped. Subsequently, the film web zones near the edge are guided under the objects until they make contact underneath them.

In this process, the film zones which have been separated in the form of a roof—to be designated as roof areas hereinafter—and which make contact along a "ridge line," enclose a triangular area, the upper corner of which is defined by the ridge line, while the two lower corners are determined by the line along which the roof areas make the transition into the vertically downward oriented side faces of the film. In devices of the prior art, this triangular area is inclined relative to the horizontal, preferably at 45°, so that the base in the feed direction of the objects is located farther forward than the top corner.

In the feed direction, the base is followed by a horizontally guided film zone which forms the top layer of the tubular wrapping.

In the devices of the prior art it was necessary to guide the film in the roof-like space between the roof areas, on the other hand, and the top layer, on the other, by inserting a guide shoe counter to the feed direction which had an inclined triangular guide area on its front end corresponding completely to the triangular area of the film. This guide shoe separated the two film halves with a tip at the top corner of the triangular area and deflected the roof areas into the vertical side faces of the film wrapping.

A disadvantage of this guide system was that a wedge separating the two film halves was located on the inside of the film, the wedge sliding along the film during its feed and capable of damaging it. Moreover, a guide shoe could be used only for one wrap dimension, and if the objects to be wrapped had different dimensions in width and height, it was necessary to exchange one guide shoe for another.

The invention is based on the objective of improving a similar device in such a manner that guidance of the film is gentler than in the devices of the prior art and that film guidance furthermore can be very simply adapted to different dimensions of the tubular wrap.

This objective is realized by the invention with a system of the initially described type based on the characteristics described herein.

With the use of separate guide rails in the roof-like space of the film deflection, based on the adjustability of the relative spacing of these guide rails and based on the possibility of adjusting the distance between the guide rails on the one hand and the ridge line, on the other, it is possible to adapt the guide system to the different dimensions of the tubular wrap in a simple manner. The triangular area of the film is freely extended and no guiding components whatsoever make contact with this area any longer. Fixation of the corners of the triangular area realized by the guide elements which determine the ridge line, which in particular fix the contacting halves of the film web in the zone above the points of the triangular, on the one hand, and by the two guide rails, on the other hand, the free ends of which form the guide surfaces for the films and thus establish the base of the triangular area.

In a preferred practical version, adjustment of the relative spacing of the guide rails is realized with a drive which operates the drive for the vertical distance between the guide rails and the guide elements defining the ridge edge via transmission components in such a manner that this distance decreases with decreasing guide rail spacing and vice versa. Thus, the distance from the ridge edge can be adjusted simply by adjusting the spacing of the guide rails, so that the triangular area formed between the guide rails and the ridge line remains similar for different dimensions.

It is of special advantage if the guide rails during adjustment of their relative spacing at the same time can be mechanically displaced parallel to the feed direction in such a manner that they are displaced opposite to the feed direction of the objects when the spacing is increased and vice versa. In the preferred practical example, this combination of displacements has the result that during an adjustment of the spacing, the front corners of the guide rails can be displaced along a line defined by the fold line of a film web on the underside of the objects. For example, if in accordance with a different width of the objects to be wrapped, the fold edge which is oriented obliquely to the feed direction becomes longer by an adjustment of the guide rail spacing, the point where the film is folded over from the vertical into the horizontal underneath the objects moves downstream opposite to the feed direction of the objects; the mechanical displacement of the guide rails opposite to the feed direction with increasing relative spacing corresponds to this displacement, so that the relative position between the deflection point of the folded film from the vertical into the horizontal under the objects, on the one hand, and the downstream end of the guide rails, on the other, remains unchanged with a change in spacing. The fold edge between these two points thus retains its inclination relative to the feed plane, provided that the guide edges in the feed plane along which the film is turned from the vertical plane into the horizontal plane underneath the objects are also displaced in the same manner as the guide rails.

It is of advantage to select the drive transmission in such a manner that an adjustment of the distance of the guide rails from the plane formed by the guide rails will correspond to twice as great a change of the spacing of the guide rails in the horizontal plane. This relationship will assure that the triangular area will remain similar during all adjustments of spacings, i.e. the side relationships and angles will be preserved. At the same time, it is assumed that when the guide rail spacing is modified with a concomitant displacement of the guide rails parallel to the feed direction, the top corner of the triangular area will also be displaced parallel to the feed plane on the guide elements in the same manner as the guide rail; this can take place simply either by a suitable displacement of the guide elements or, if the latter are designed as rods, by displaced infeed of the film webs in the axial direction of the guide elements. The inclination of the triangular area relative to the horizontal feed plane thus also remains unchanged.

In a preferred practical version, provision is made for the transmission to have a vertical adjusting spindle for adjusting the distance between the guide elements and the plane defined by the guide rails as well as two horizontal adjusting spindles, one each for each guide rail, located transverse to the feed direction, and for the adjusting spindles to be simultaneously rotatable, the guide rails being displaceable in opposite direction transverse to the feed direction. This can be realized, for example, in such a manner that rotation of the vertical adjusting spindle turns both horizontal adjusting spindles in the same direction of rotation; in that case, the two adjusting spindles have the opposite direction of screw rotation. In another version, the two horizontal adjusting spindles are driven in opposite direction during rotation of the vertical adjusting spindle and the direction of screw rotation of the two horizontal adjusting spindles can then be the same.

Drivers for the guide rails can be located on the two horizontal spindles.

It is of advantage for each of the guide rails to be displaceable along a guide track located in a horizontal plane and extending in the feed direction diagonally from outside to the center of the feed track. This arrangement allows the above-mentioned simultaneous modification of the spacing of the guide rails and the position of the guide rails parallel to the feed direction.

At the same time, a sliding block can be located on each guide track in fixed connection with the respective guide rail and connected with a driver which is drivable transversely to the feed direction, so that a relative displacement parallel to the feed direction is possible. If this driver is driven—for example, via the aforementioned horizontal spindles—transversely to the feed direction, it displaces the guide rails along the guide rails located obliquely to the feed direction.

In a preferred practical example, provision is made that the triangular area will be inclined by 45° to the horizontal, that the connecting edge from the downstream ends of the guide rails to the downstream ends of the outer edges of the guides located in the feed plane vertically under the guide rails and extending parallel to the feed direction will be located in a vertical plane parallel to the feed direction and also to be inclined by 45° to the horizontal, that the guide tracks of the guide rails form an angle of 45° relative to the feed direction and that the ends of the outer tabs of the guide can be displaced parallel to the guide track of the guide rails. This preferred design permits wrinkle-free placement of the film web around the object and the simplest possible adjustment of the infeed to the width of the objects to be wrapped.

In another preferred practical example, the guide rails are connected via several parallel swinging connecting rods to a central girder holding a device for adjusting the spacing of the two guide rails. It is of special advantage if the device for adjusting the spacing of the two guide rails comprises a spindle which can be screwed into the girder parallel to the axial direction of the guide rails and if a rotatable but axially fixed bearing block is located on the spindle and connected with the two guide rails via one swinging connecting rod each. By turning the spindle into the girder to a greater or smaller depth, the swinging connecting rods are swung out different distances, thus mechanically modifying the guide rail spacings. Provision can be made for the central girder to be displaceable in axial direction and supported in different positions which can be fixed on the machine frame.

It is advisable in all cases for the guide rails to be mounted on a bracket supported and movable on the machine frame, with a displacement path having at least a vertical component. This allows the wrapping to be adapted to the height of the objects to be wrapped.

A spindle drive can be provided for adjustment of the bracket.

According to a first preferred practical version, provision is made that the bracket is displaceable along a guide track extending parallel to the connecting line between the downstream end of a guide rail and the downstream end of the outer edge of a guide assigned to each guide rail, the guide being located vertically under each guide rail in the feed plane of the objects and extending parallel to the feed direction. During a displacement of the bracket along this guide track, the height of the wrapping can be adjusted to the objects, although by displacing the bracket along this guide track, the ridge edge, the two roof areas, the triangular area between them, the deflection of the roof areas into the vertical side faces and finally the deflection of the triangular area into the horizontal top face remain unchanged, while the displacement of the guide elements and guide rails defining these areas takes place parallel to the described film edge, so that the latter is only increased in length but completely retains its direction.

It is of advantage if the guide elements defining the ridge edge are also mounted on the bracket.

In addition, provision can be made that the guide elements on the bracket can be displaced parallel to the axial extension of the guide rails and can be fixed in different positions. It is of advantage for the guide elements to be displaceable in vertical direction on the bracket and adjustable in different positions. A spindle drive can be provided on the bracket for the vertical adjustment of the guide elements.

It is also of advantage for the guide elements to be designed in rod form and mounted on the bracket by means of a clamp in which they can be axially displaced after loosening of the clamp.

Furthermore it is of advantage if the feed plane contains flat guides with outer edges which can be fixed in various positions in such a manner that the distance of the outer edges extending parallel to the feed direction can be adjusted to the width of the objects to be packaged. The spacing of the edges is adjusted in accordance with the spacing of the guide rails, so that the folded film halves are folded over by the guide rails into a vertically extending side wall, and this occurs with every spacing of the guide rails.

The guides are preferably adjustable along the downstream fold edge of the film web formed by the contacting parts of each half of the film web below the guide carrying the objects. This preferred displaceability of the guides displaces the downstream foldover point of the double film from the vertical into the horizontal underneath the objects, moving it opposite to the feed direction in the case of an increase of the spacing, so that the fold edge under the objects is only lengthened. This is of particular advantage if the guide rails during a spacing adjustment in the above-described manner are displaced along a guide track oriented obliquely to the feed track, since the relative position of the downstream ends of the guide rail, on the one hand, and the guide located in the feed plane, on the other hand, remains unchanged during the spacing adjustment.

It is of advantage if the fold edge of the two film halves underneath the objects extends at an angle of 45° to the feed direction from outside to the center of the feed system.

In a preferred practical example, provision is made that one guide rail and one guide each are coupled in such a manner that during a change in spacing of the guide rails they are displaceable together with these in the same manner. This makes it possible to retain the fold edge between the guide rail end and guide end and the inclination of this fold edge and in addition preserves vertical guidance of the films along the side wall.

The following description of preferred practical versions of the invention together with the drawing will serve for a more detailed explanation.

Figure 1:
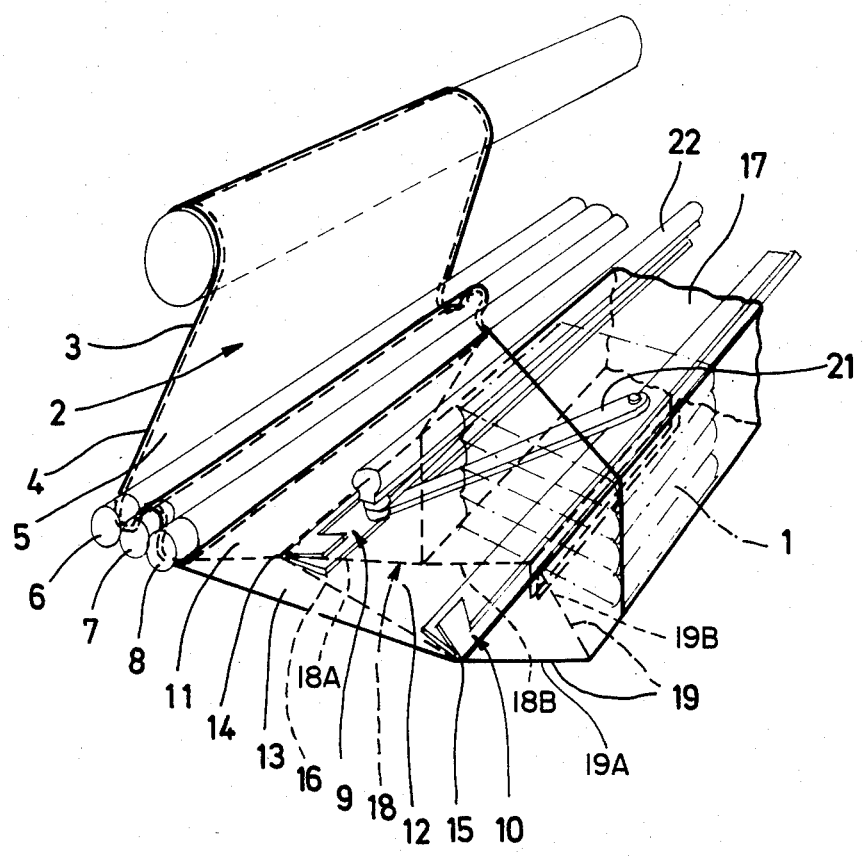
FIG. 1 shows a view in perspective of a first preferred practical example of a deflection device for a film web.

The film deflection device shown in the figures is used in a packaging machine, not shown in the drawing, in which a number of objects 1, e.g., a stack of books, is advanced along a feed plane. The objective of the film deflection device is to apply a film web 2, which is folded along its axial midling edge 3 so that the two film web halves 4, 5 make flat contact with each other, around the fed objects in tubular form in such a manner that the zones extending parallel to the edges of the film web make flat contact with each other underneath the objects. The objects thus enclosed by a film in tubular form are advanced along a feed plane which has a gap in its center. The edge end zones, extending downward from the objects and making flat contact with each other, project through this gap. In the further operation of the device, these zones are welded by a generally known method, so that the film surrounding the objects is closed in tubular form. Deflection of the film web must take place in such a manner that this film which is fed from the top vertical to the feed direction in a vertical plane located parallel to the feed direction will not impede the infeed of the sequentially fed objects.

In order to realize this, the continuous film web 2 with the two film halves 4 and 5, making flat contact with each other, is looped around two parallel side-by-side rolls 6 and 7, placed parallel to the feed direction above the feed plane of the objects. The films are looped around the rolls in opposing directions, i.e. viewed in cross-section, the film follows an approximately S-shaped path. The two rolls are provided with an adhesive coating offering high friction to the film material. A narrow nip between the two rolls allows passage of the film. A third roll 8 is assigned to the second roll 7 parallel to the latter and the two film halves travel between rolls 7 and 8 in downward direction. The third roll 8 can also be replaced by a guide rod.

Below the rolls, two guide rails 9, 10, located side-by-side in a horizontal plane, extend parallel to the feed direction of the objects and are arranged in such a manner that the area formed by them corresponds in height and width approximately to the top side of the objects 1 to be packaged. Below the rolls, the two film halves 4 and 5 separate in the form of roof areas 11 and 12 inclined toward each other, with the "ridge edge" of this roof being defined by the nip between rolls 7 and 8. The lower edge of these roof areas 11 and 12 is defined by the guide rails 9 and 10 over which the two film halves travel; subsequently, the film halves are guided vertically downward around guides, not shown in FIG. 1, extending parallel to guide rails 9 and 10, so that they finally adhere to the underside of the objects 1, while the edge zones of the film halves project from the underside of the objects as described above and make flat contact with each other in this zone.

The two roof areas 11 and 12 form a triangular area 13, the top vortex of which is located at the site where the axial midline edge 3 of film web 2 travels between rolls 7 and 8, while the other two corners of the triangular area 13 are formed by ends 14 and 15, respectively, on the infeed-side of guide rails 9 and 10. The guide rails have such a distance from the top corner of the triangular area 13 in the feed direction of the objects that the triangular area is inclined preferably at an angle of 45° from the top corner to the base in the feed direction of the objects. From base 16 of the triangular area 13, the film, while adhering to the underside of the guide rails 9 and 10, travels in a horizontal area 17 which makes contact with the top of the advanced objects and forms the top layer of the tubular wrap.

Starting from ends 14 and 15 of the guide rails 9 and 10, respectively, the zones of the film web which have been deflected vertically downward via the guide rails 9 and 10 are folded over along an edge 18 and 19, respectively, extending obliquely, preferably at an angle of 45°, relative to the axial direction of the film, so that with the further feed of the film web, the film web zones which initially had an outside location are now placed on the inside of the tube surrounding the objects and adhere directly to objects 1. Each edge 18, 19 comprises respective segments 18A, 18B in the case of edge 18 and segments 19A, 19B in the case of edge 19. The edges 18A, 19A incline downwardly and rearwardly relative to the ends 14 and 15 of the guide rails 9 and 10 while the segments 18B, 19B extend rearwardly and inwardly from the respective segments 18A, 19A.

As mentioned, deflection of the film web halves from the inclined roof areas 11 and 12 into the vertical side surfaces and the definition of the bottom corners of the triangular area 13 are realized by two guide rails 9 and 10 placed parallel to the feed direction of the objects. In a first practical version, explained in the following on the basis of FIGS. 1–5, these rails are rotatably driven via parallelogram connecting rods 20, 21 on a rail-like girder 22 extending parallel to and arranged between the guide rails (FIG. 3). The guide rails themselves have a V-cross-section and are arranged so that one leg is in approximately horizontal position and tabs 23 and 24 connecting the two legs face away from each other (FIG. 4).

As can be seen in FIG. 3, each of two additional connecting rods 25 and 26 are connected in articulated manner with, on the other hand, one respective guide rail, and on the other hand, with a bearing block 27 giving support in a rotatable but, with respect to bearing block 27, in axially rigid manner to a spindle 28 screwed into an internally threaded bore in girder 22. By screwing spindle 28 into the threaded bore to a greater or smaller depth by means of a crank which is not shown in the drawing, it is possible to swing the connecting rods 25 and 26 relative to girder 22 in such a manner that the spacing of the guide rails can be modified. This is shown by the double arrows A in FIG. 3. In this drawing, the guide rails are shown in solid lines in close position and in dash-dot lines in more distant position.

The rail-like grider 22 is mounted to a bracket 29 the underside of which has a groove 30 parallel to the feed direction of the objects, in which the girder 22 is engaged. The girder can be clamped into this groove, for example, by a locking bolt 29*a* screwed laterally into the bracket. By loosening this locking bolt, the girder can be displaced along groove 30 so that the girder, together with the guide rails supported on it, can be adjusted in different positions parallel to the feed direction. FIGS. 2 and 3 show a first position of the guide rails by solid lines and a second by dash-dot lines.

A vertical slide guide 31 on bracket 29 gives vertically displaceable support to a retainer 32 for rolls 6, 7 and 8 or for the parallel guide rods in place of the rolls, where a spindle 33, screwed into a nut 34 placed on bracket 29, and connected rotatably and axially undisplaceably with retainer 32, can be provided for adjusting the vertical position of retainer 32 relative to bracket 29. In this manner, the rolls or guide rods can be adjusted in their distance from the feed plane so that the height of the ridge edge defined by these elements is adjustable. FIG. 4 shows rolls 6, 7 and 8 in an upper position by the solid line and in a lower position by dash-dot lines.

In this connection, it must be pointed out that when rolls 6, 7 and 8 are replaced by corresponding guide rods, it may be of advantage to provide them with pressure pads in the zone above the top corner of the triangular area 13 to compress the two film web halves. These pressure pads prevent displacement of the film webs parallel to the fed direction of the objects and define the top corner of the triangular area 13. With regard to the design of the rolls and pressure pads, reference is made to Patent Application No. P 31 25 352.0 of the same applicant filed on the same date, the contents of which are expressly made the contents of the present application.

Holder 29 itself is vertically displaceable and supported on the machine frame; the necessary slide guides are not shown in the drawing. For example, this can be realized by mounting the bracket on a cross-member 35 (FIG. 4) guided in a vertical slide guide on the machine frame and adjustable in vertical direction via a spindle drive similar to the spindle drive 33 of the retainer. The displaceability of the bracket 29 relative to the machine frame and of the retainer 32 relative to bracket 29 is indicated by double arrows B and C, respectively, in FIG. 2. FIGS. 2 and 4 show the bracket in solid lines in the lower position and in dash-dot lines in a higher position.

As a result of the possible adjustments of the guide rails, on the one hand, and the rolls or guide rods—provided with pressure pads—defining the ridge edge, on the other hand, the entire deflection device can be optimally adjusted to the respective size of the objects to be wrapped. An adjustment to the height of the objects takes place by adjusting the height of bracket 29 and to the width of the objects by adjusting the spacing of the guide rails 9 and 10 by means of spindle 28.

The size of the triangular area 13 and its inclination can be established by modifying the vertical distance between guide rail and rolls or guide rods, i.e. by operating spindle 33. The inclination of the triangular area can also be influenced by a displacement of the girder 22 parallel to the feed direction, so that the triangular area in a preferred adjustment will have a 45° inclination to the horizontal. By a suitable arrangement of the girder in horizontal direction, the edges 18 and 19 originating from the lower corners of the triangular area can also be designed such that they include an angle of 45° to the horizontal.

The arrangement described above is extremely flexible; it can be adjusted to objects of the most diverse sizes and nevertheless leads to a considerably gentler guidance of the film in the deflection and infeed zones.

A further possibility of adjustment can be provided by making rolls 6, 7 or the guide rods replacing them displaceable in the axial direction in retainer 32. Retainer 32 can be designed as a clamp retainer which fixes the guide rods in axial direction by means of a lock screw. The displaceability of rolls 6, 7 or 8 is designated by the double arrow D in the drawing.

Figure 5:
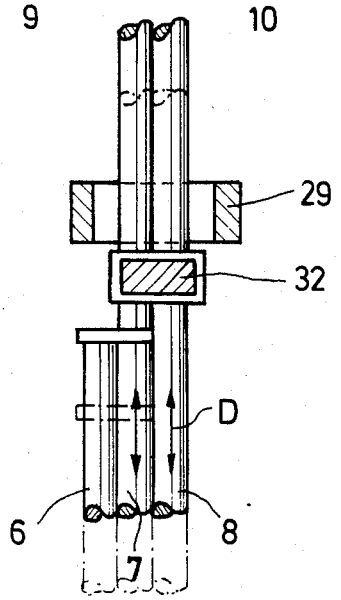
FIG. 5 is a sectional view along line 5—5 in FIG. 4.

FIG. 5 shows the rolls in a first position in solid lines and in a second position in dash-dot lines.

This adjustment option also serves to influence the inclination of the triangular area 13 in the case when rolls 6, 7 and 8 or the guide rods replacing them, which have clamping elements for the film web, are displaced in axial direction. Since the clamping element as well as the rolls hold the films in axial direction and in particular, define the top corner of the triangular area 13, an axial displacement leads to a modification in inclination of the triangular area.

In a further preferred practical example explained in the following on the basis of FIGS. 6–9, the spacing adjustment of the two guide rails can be combined with the height adjustment of the guide rods or rolls which define the ridge edge, so that the vertical distance between the horizontal plane formed by the guide edges and the ridge edge is modified with a modification of the spacing of the guide tabs of the guide rails. On the whole, this makes it possible that the triangular area forming between the film web halves will retain a similar geometry, so that the same infeed relations are retained for the film despite a change in spacing of the guide rails.

Figure 2:
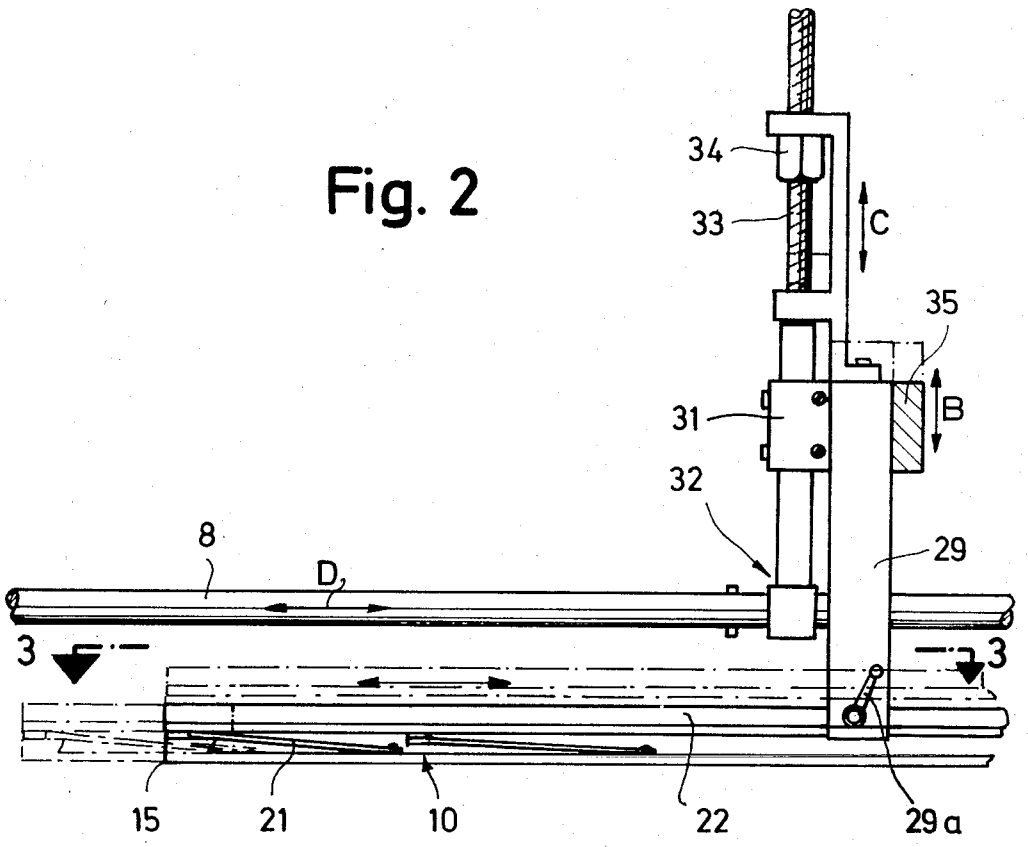
FIG. 2 is a schematic side view of the deflection device of FIG. 1.
Figure 3:
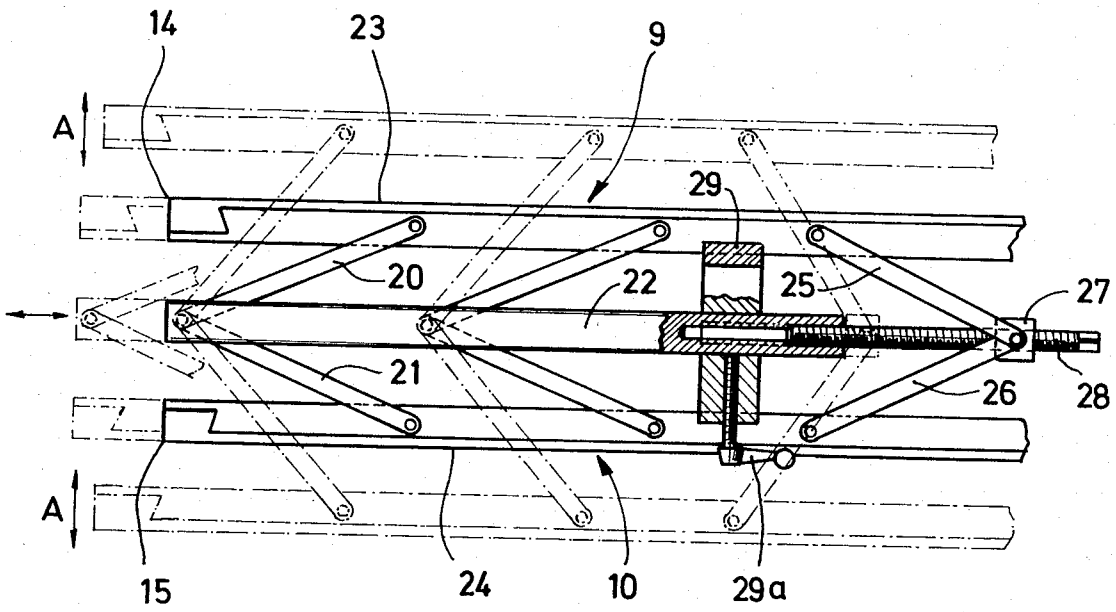
FIG. 3 is a sectional view along line 3—3 in FIG. 2.
Figure 4:
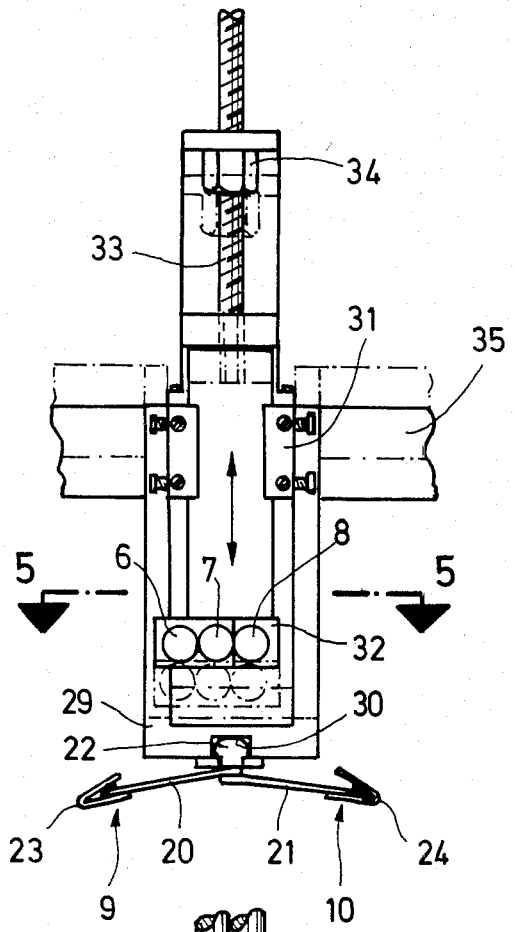
FIG. 4 is a view of the device of FIG. 2 in the feed direction of the objects.

The basic design of this practical example is the same as in the practical example of FIGS. 1–5, and in particular, a film guide system results which corresponds to that shown in FIG. 1.

Differences exist only in the adjustment options of the guide rails and the guide elements. Parts corresponding to each other therefore have the same reference numbers in the following.

Figure 6:
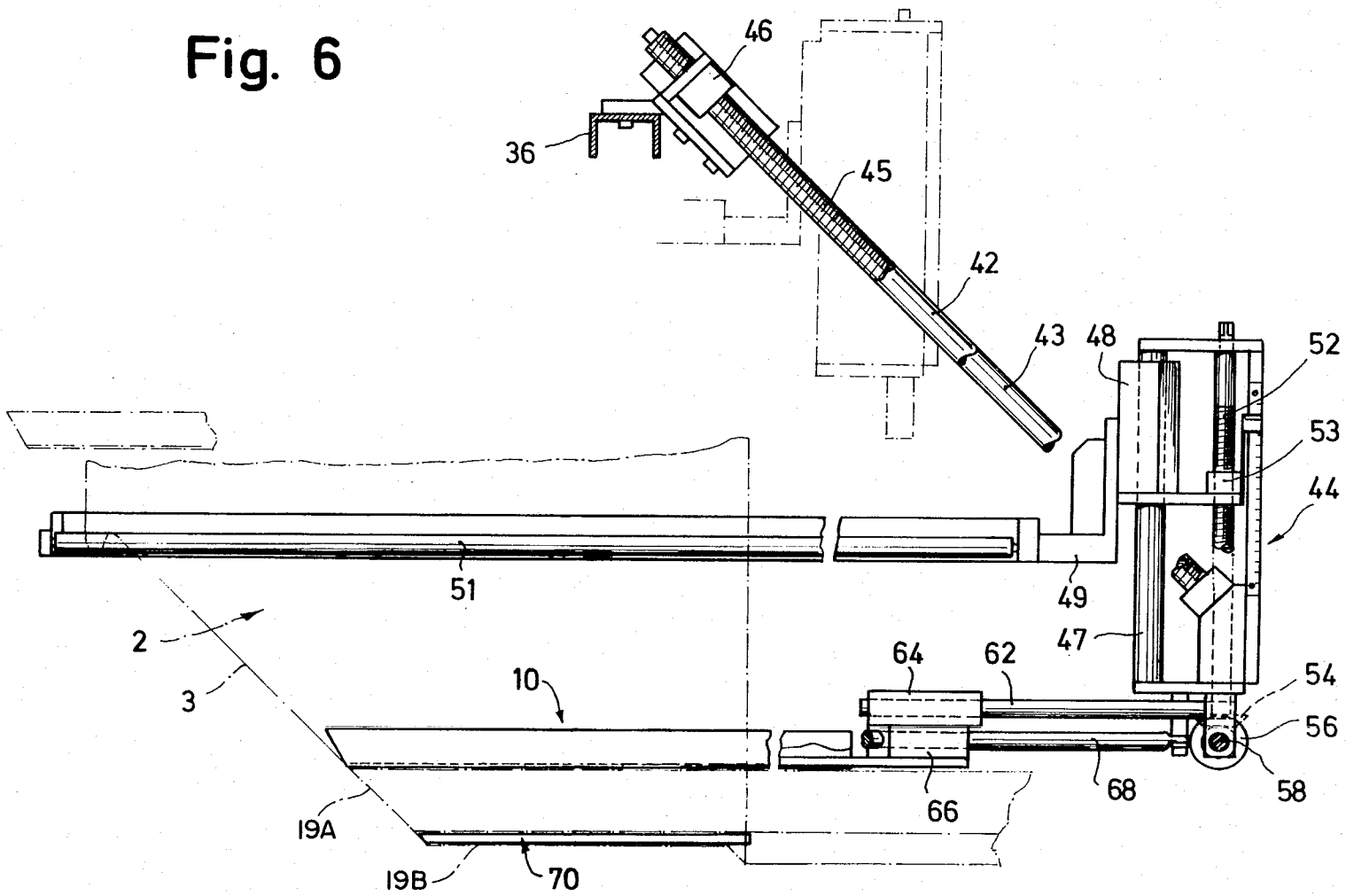
FIG. 6 is a schematic side view corresponding to FIG. 2 showing another preferred practical example of a deflection device.

A cross member 36 rigidly mounted to the machine carries two slide guides 40 and 41 in which two guide rods 42 and 43 are displaceable, carrying at their lower end a bracket 44, the function of which basically corresponds to that of bracket 29 of practical example 1. The guide rods are inclined to the horizontal feed plane in the manner shown in FIG. 6—at an angle of 45° in the preferred practical example—so that they extend from top to bottom in the feed direction. An adjusting spindle 45, carried rotatably in bracket 44 and screwed into an internally threaded bearing 46 on cross-member 36, is provided parallel to the two guide rods 42 and 43 (FIG. 6). By turning the adjusting spindle 45 by means of a crank which is not shown in the drawing, the entire bracket 44 can be displaced in the direction of guide rods 42 and 43.

FIG. 6 shows the bracket in a lower position in solid lines and in an upper position in dash-dot lines.

Holder 44 has a vertical guide rod 47 supporting a sliding sleeve 48 in displaceable manner which carries a retainer 49 for two horizontal guide elements 50, 51 placed parallel to the feed direction. Guide elements 50, 51 can be designed in the form of rolls 6, 7, 8 of the practical example of FIGS. 1–5, but it is also possible to use two parallel shafts as guide elements carrying pressure pads on their ends through which the film web is fed. In this regard, reference is made to the corresponding discussions concerning the example of FIGS. 1–5.

The sliding sleeve 48 with retainer 49 and guide elements 50, 51 can be displaced along guide rod 47 and for this purpose, an adjusting spindle 52, screwed into a driver 53 connected with the sliding sleeve 48, is rotatably placed on bracket 44 parallel to guide rod 47 (FIG. 6).

Figure 7:
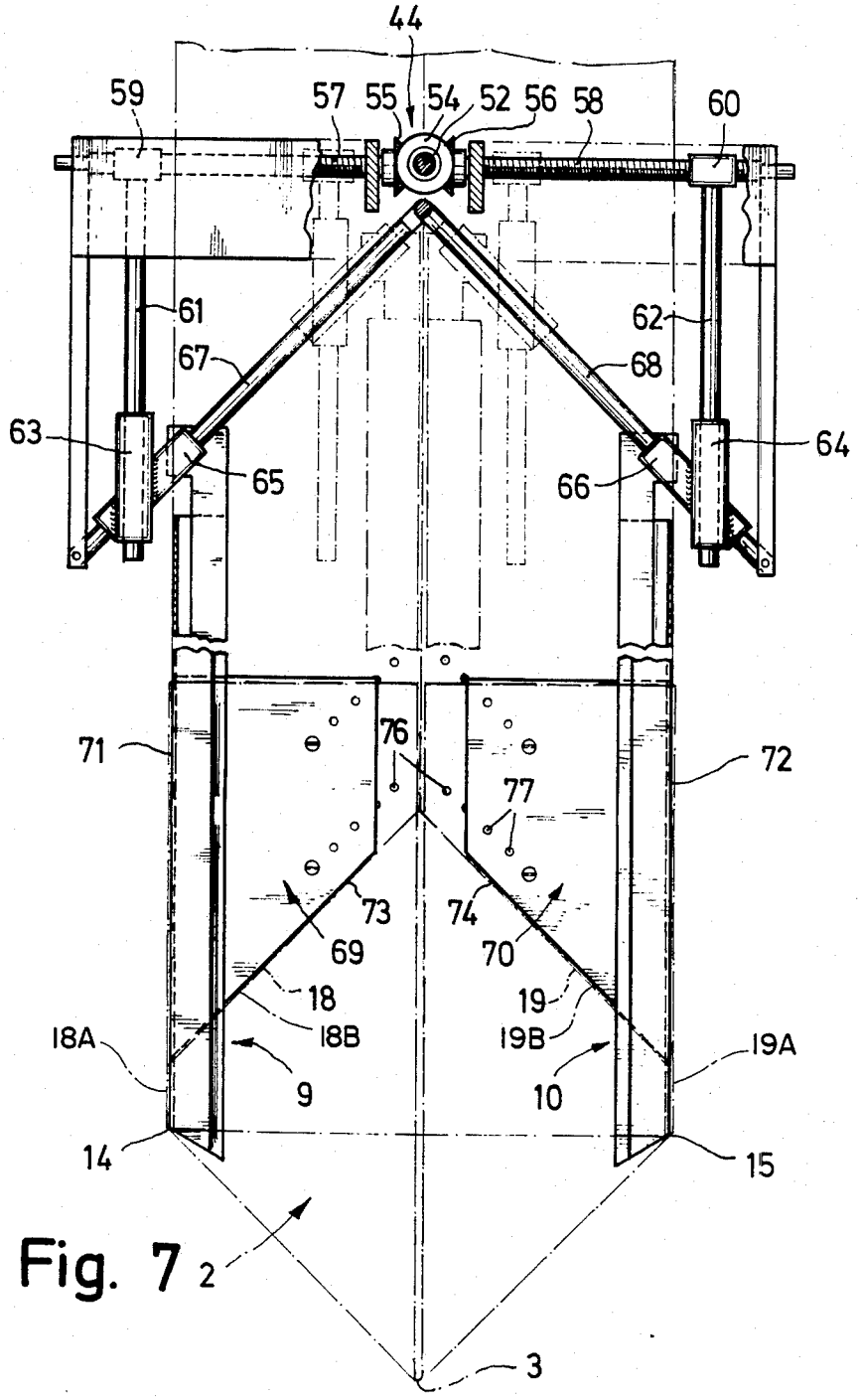
FIG. 7 is a sectional view of the deflection device of FIG. 6 corresponding to FIG. 3.

On the underside of bracket 44, the adjusting spindle 52 carries a bevel gear 54 which mates with two bevel gears 55 and 56, respectively, on the ends of two horizontally arranged adjusting spindles 57 and 58. As indicated particularly in FIGS. 7 and 9, the vertical adjusting spindle 52 is located in the center of the feed track, while the two adjusting spindles 57 and 58, the length of each of which corresponds to the half-width of the feed track, extend in horizontal direction transverse to the feed track. Each of these two adjusting spindles 57 and 58 is screwed into a driver 59 and 60, respectively, which is thus displaceable along the adjusting spindle with rotation of the latter. Each of these drivers carries a slide bar 61 and 62, respectively, on which an axially displaceable pilot bushing 63 and 64, respectively, is slipped. Each of these pilot bushings is rigidly joined with a second pilot bushings 65 and 66, respectively, each displaceably supported on another horizontal slide bar 67 and 68, respectively. The two slide bars 67 and 68 extend obliquely to the feed direction from outside to inside and meet in the center of the feed track (FIG. 7). In the preferred practical example, they each form an angle of 45° with the feed direction.

The pilot bushings 65 and 66 displaceably supported on these slide bars 67 and 68 are rigidly connected with guide rails 9 and 10 which completely correspond to the guide rails 9 and 10 of the example of FIGS. 1 and 2.

As a result of the described construction, rotation of the vertical adjusting spindle 52 at the same time also rotates the two adjusting spindles 57 and 58, so that a change of the distance of guide elements 50 and 51 from the plane formed by guide rails 9, 10 and a displacement of the guide rails 9, 10 along slide bars 67 and 68 take place simultaneously. Thus, the slide bars change their spacing, on the one hand, and on the other hand, they are displaced parallel to the feed direction—opposite to the latter with an increase of their spacing and vice versa. FIG. 7 shows drivers, the joined slide bars, pilot bushings and guide rails in dash-dot lines for a position with a small spacing of the guide rails and in solid lines for a relatively large spacing.

The reduction ratios are selected such that a certain change in distance between the guide elements and the plane formed by the guide rails results in double the change of spacing of the guide rails. By the 45° inclination of the slide bars 67 and 68 relative to the feed direction, this simultaneously results in a displacement of the guide rods in (or opposite) the feed direction corresponding to the movement of each guide rail transversely to the feed direction.

Figures 8, 9:
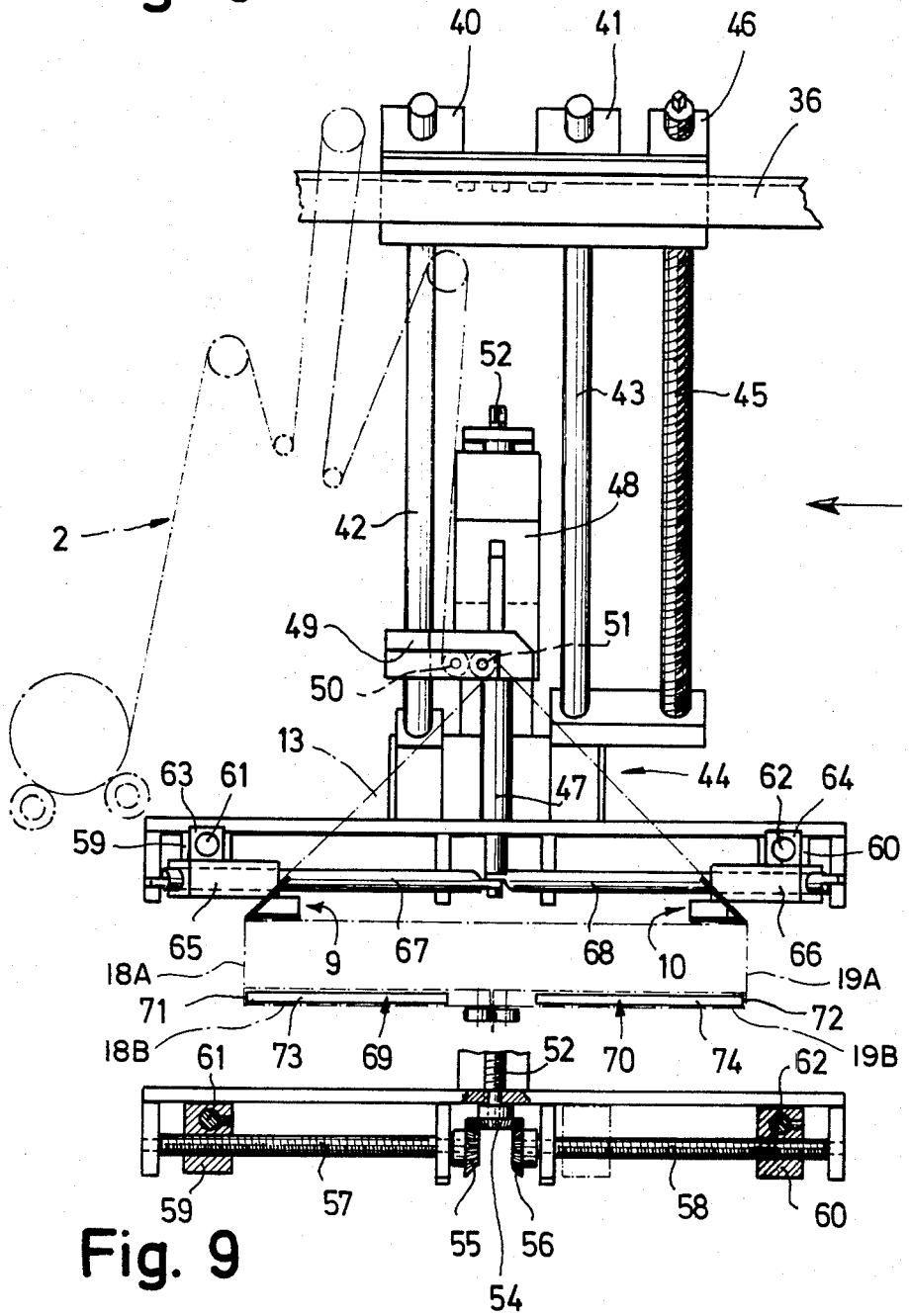
FIG. 8 is a view of the deflection device of FIGS. 6 and 7 in the feed direction.
FIG. 9 is a partial view of the drive transmission for the simultaneous adjustment of the guide rail spacing and of the distance between the plane formed by the guide rails, on the one hand, and the guide elements, on the other.

Below the guide rails 9 and 10, flat guides 69 and 70 are located in the feed plane with outer edges 71 and 72 which extend parallel to the feed direction and are placed exactly perpendicular below the outer tabs 23 and 24 of guide rails 9 and 10 (FIG. 8). The guide plates can be displaced on a flat support parallel to a direction defined by the fold edge of the film halves below the fuel area. This fold edge is identified by references 18 and 19, respectively, in FIG. 1. The flat guides can be joined to their support in different positions; for this purpose, the supports as well as the plates have a number of bores 76 and 77, respectively, which also have a path parallel to the fold edges 18 and 19, respectively.

In operation, the film is looped around guide elements, guide rails and guides located in the feed plane in the same manner as in the practical example of FIG. 1. To adjust the film guide system to a certain object size, a certain distance between the plane formed by the guide rails, on the one hand, and the guide elements, on the other hand, is preselected first; this can be done, for example, before engagement of the bevel gears 54 as well as 55 and 56. By adjusting this distance, the height of the roof above the plane formed by the guide rails is preset. Subsequently, the above-described drive connection is restored between the adjusting spindles, so that a height adjustment as well as a spacing adjustment of the guide rails can now only be performed simultaneously.

This aforementioned adjustment is made independent of the respective object size and is performed once, at the time of startup of the total system.

For an adjustment to a certain object size, the spacing of the guide rails is now adjusted to the width of the objects by operating adjusting spindle 52. This modifies the base of the triangular area 13. At the same time, however, the distance of the guide elements from the plane formed by the guide rails is changed in the same ratio, so that the triangular area 13 obtained is similar to the previous one, i.e. the angles of the triangle as well as the length ratio of the sides of the triangular area are retained.

Furthermore, guides 69 and 70 are adjusted so that the outer edges 71 and 72 of these guides are located exactly perpendicular below the center tabs 23 and 24 of guide rails 9 and 10. In accordance with the respective width of the objects, this shortens or lengthens the fold edges 18 and 19, so that the points where these fold edges are deflected into the vertical at the outer edges 71 and 72 of the guides, are advanced or retracted in the feed direction. It must be kept in mind here that the location where the two edges 18 and 19 converge in the center of the guide track is to be retained regardless of the respective width of the object.

Guides 69 and 70 are located between the two folded layers of the respective film half and define the path of the fold edges 18 and 19, respectively, of the two film web halves by an edge 73 and 74, respectively, extending obliquely from outside to inside.

Since the two guides 69 and 70 can be displaced exactly parallel to these fold edges, their edges 73 and 74 will always contact the fold edges 18 and 19 in all possible positions at all spacings of outer edges 71 and 72, and the acute-andled corner between edges 73 and 74 as well as outer edges 71 and 72, respectively, always defines exactly the deflection point of the fold edge from the vertical into the horizontal plane.

As mentioned, the corner between the outer edges 71 and 72 and edges 73 and 74, respectively, of the guides also moves in (or opposite to) the feed direction during a spacing adjustment. At the same time, however, the end point of the guide rails 9 and 10 also moves in (or opposite to) the feed direction with a change in spacing, since as a result of the displacement along the slide bars 67 and 68, the guide rails are subject to a displacement component transverse to as well as to one parallel to the feed direction. The displacement parallel to the feed direction is exactly as great as the displacement of the front corner of guides 69 and 70, since the guides, on the one hand, and the guide rails, on the other, are displaced parallel to each other. This has the result that the fold edge, extending from the front corner of the guides to the end point of the guide rail located directly above, which is a continuation of fold edges 18 and 19, respectively, always retains the same angle, i.e. 45° in the preferred practical example, in the vertical connecting plane between the outer edges of the guides and the outer edges of the guide rails, regardless of the respective width adjustment of the guide rails and guides. A readjustment thus becomes unnecessary even with a change in width.

It is of advantage if the triangular area 13 is always inclined by 45° relative to the feed plane in all cases, so that this area shows constant continuity in the zone of the fold edges 18 and 19 between the guide rails and guides. In order to realize this with a change in the width adjustment of the guide rails, which is accompanied by a displacement of the end of the guide rails as well as by a change in distance between guide elements and guide rail plane, it is necessary to select a suitable position for the infeed of the downstream fold edge 3 of the folded film web, which is introduced vertically from the top, into the guide elements. This can be readily realized by a suitable film infeed and, if desired, by suitable markings along the guide elements corresponding to a given object width.

After the width adjustment as described, the infeed device described can also be adjusted to the respective height of the objects. This takes place in a simple manner by operating the adjusting spindle 45. This displaces the bracket together with the guide rails as well as the guide elements and all of the retainers and displacement devices assigned to these along guide rods 42 and 43. The latter extend parallel to the zone of the fold edges 18 and 19 between guide and guide rail, as indicated by the dash-dot position of the raised guide rail in FIG. 6. This makes it possible for the fold edges 18 and 19 to be only lengthened or shortened with a change in object height, while the subsequent shape of the roof areas as well as the triangular area within them remain completely unchanged with this displacement. Consequently, no further readjustments whatsoever are possible.

It is clear from the above description that the practical example of FIGS. 6–9 allows a particularly simple film infeed for objects of different width and height, where the adjustment for width and height can be made completely independently. Only an operation of adjusting spindle 45 (for the height adjustment) or of adjusting spindle 57 and a displacement of guides 69, 70 (for a width variation) is necessary for this purpose. Despite this simple operation, the infeed ratios of the film, the directions of their fold edges and the contact of the guides with the edges where the films are deflected area completely retained.

For the sake of completeness alone, it is pointed out that under suitable conditions, characteristics which were described in connection with the practical examples of FIGS. 1–5, on the one hand, and FIGS. 6–9, on the other, can also find use in the respective other example. For example, for a height adjustment, it is also possible for bracket 29 of the example of FIGS. 1–5 to be displaced in an area inclined to the feed plane and extending parallel to the triangular area 13. Guides 69 and 70 can also be used in the example of FIGS. 1–5.

The guide elements of the example of FIGS. 6–9, just like the guide elements of the example of FIGS. 1–5, can be designed to be adjustable parallel to the feed direction.

The drive means for the simultaneous adjustment of the spacing of the guide rails and of the distance of the guide elements from the guide rail plane discussed as part of the present practical example of FIGS. 6–9 are not the only possible practical example, the only important factor being that a simultaneous drive exists.

We claim:

1. In a packaging machine for wrapping objects sequentially fed into the machine with film from a continuous film web folded into two halves flat against each other about an axial midline and in which the two folded film web halves are fed in a vertical plane located parallel to the feed direction of objects into the machine, a device for deflecting the two folded film web halves so as to cause the web to open along its axial edges comprising means for causing separation of the two folded film web halves in a roof-like manner along a ridge edge line extending parallel to the feed direction of the objects such that the two film web halves are formed into respective roof side zones extending from the respective axial edges of the web parallel to the feed directions of the objects to a triangular roof end zone opposite where the two film web halves axial edges have been opened and the triangular zone has an apex at the ridge edge line and a base which is transverse to the object feed direction and spaced from the apex of the triangular zone toward the open axial edges of the web and for forming the web into a top covering zone for the objects which extends horizontally from the base of the triangular zone and into further covering zones which extend vertically downwardly from the roof side zones for covering the sides of the objects and thence horizontally underneath the objects for covering the bottoms of the objects, said device comprising two guide rails having free ends and extending parallel to the feed direction of the objects and which pass through the open axial edges of the two film web halves to engage the film web such that the free ends of the guide rails are at the ends of the base of the triangular zone and each guide rail engages a corresponding film web half at where the corresponding further zone extends downwardly from the corresponding roof side zone with said device being characterized by the fact that there are provided means for selectively spacing the guide rails in relation to each other dependent upon object size and means for selectively spacing the guide rails vertically in relation to the ridge edge line dependent upon the space between the guide rails as set by said means for spacing the guide rails relative to each other.

2. Device according to claim 1, characterized by the fact that for selectively adjusting the relative spacing of the guide rails a drive is provided which also selectively adjusts the vertical distance between the guide rails and guide elements defining the ridge edge line, the operative coupling being by means of a transmission in such a manner that the vertical distance decreases with decreasing spacing of the guide rails and vice versa.

3. Device according to claim 2, characterized by the fact that the guide rails during adjustment of their relative spacing at the same time are mechanically displaceable parallel to the feed direction of the objects in such a manner that the guide rails are displaced counter to the feed direction of the objects with an increase of their spacing and vice versa.

4. Device according to claim 3, characterized by the fact that an adjustment of the distance of the guide elements from a plane defined by the guide rails corresponds to twice as great a change of the spacing of the guide rails in their plane.

5. Device according to claim 2, characterized by the fact that the drive and transmission for adjusting the spacing of the guide rails and the distance between the guide elements and guide rails comprises a vertical adjusting spindle for adjusting the distance between the guide elements and the plane defined by the guide rails as well as two horizontal adjusting spindles located transversely to the feed direction, one for each of the guide rails and that the adjusting spindles are at the same time rotatable, the guide rails being displaceable in the opposite direction transverse to the feed direction.

6. Device according to claim 5, characterized by the fact that drivers for the guide rails are carried on the two horizontal spindles.

7. Device according to claim 4, characterized by the fact that the guide rails are displaceable, each along one guide track located in a horizontal plane, extending diagonally from outside of the feed path of the objects to the center of the feed path.

8. Device according to claim 7, characterized by the fact that a sliding block which is firmly connected with a corresponding guide rail is carried on each guide track and is connected with a driver that can be driven transversely to the feed direction, so as to allow a relative displacement parallel to the feed direction.

9. Device according to claim 3, characterized by the fact that the triangular zone is inclined 45° to the horizontal, that guide tracks for the guide rails form an angle of 45° to the feed direction, and that the ends of outer edges of the guide rails can be displaced parallel to the guide track.

10. Device according to claim 1 characterized by the fact that the relative position of the guide rails with respect to guide elements defining the ridge edge line can be adjusted in horizontal direction.

11. Device according to claim 1, characterized by the fact that the position of the guide rails can be adjusted with respect to the distance from the feed area of the objects.

12. Device according to claim 1 characterized by the fact that the guide rails are connected to a center girder via several parallel swinging brackets and that a device for adjusting the spacing of the two guide rails is mounted on this girder.

13. Device according to claim 12, characterized by the fact that the device for adjusting the spacing of the two guide rails comprises a spindle which can be screwed into the girder parallel to the axial direction of the guide rails and that the spindle carries a rotatable but axially nondisplaceable bearing block which is connected with the two guide rails via one swinging connecting rod for each.

14. Device according to claim 12, characterized by the fact that the central girder can be displaced parallel to the axial direction and is carried on a frame of the machine so that it can be fixed in different positions.

15. Device according to claim 1 characterized by the fact that the guide rails are mounted to a bracket carried on a frame of the machine, which bracket is guided on the latter in displaceable manner, the displacement path having at least one vertical component.

16. Device according to claim 15, characterized by the fact that a spindle drive is provided for adjusting the bracket.

17. Device according to claim 15, characterized by the fact that the bracket can be displaced along a guide track extending parallel to a connecting line between the free end of a guide rail and the free end of the outer edge of a guide assigned to each guide rail, the guide being located vertically under each guide rail in the feed plane of the objects and edtending parallel to the feed direction.

18. Device according to claim 15, characterized by the fact that guide elements defining the ridge edge are also held on the bracket.

19. Device according to claim 18, characterized by the fact that the guide elements can be fixed on the bracket parallel to an axial extension of the guide rails so that they can be displaced and fixed in different positions.

20. Device according to claim 18, characterized by the fact that the guide elements on the bracket can be displaced in vertical direction and adjusted in different positions.

21. Device according to claim 20, characterized by the fact that a spindle drive is provided on the bracket for the vertical adjustment of the guide elements.

22. Device according to claim 19, characterized by the fact that the guide elements are designed as rods and are held on the bracket by means of a clamp in which they can be displaced in axial direction after loosening the clamp.

23. Device according to claim 1 characterized by the fact that flat guides with outer edges are provided in the feed plane and can be fixed in various positions in such a manner that the spacing of the outer edges extending parallel to the feed direction can be adjusted to the width of the objects to be wrapped.

24. Device according to claim 23, characterized by the fact that the guides are located below the feed plane and are adjustable along folds of the film web.

25. Device according to claim 24, characterized by the fact that each of the guides has an edge extending inward from the outer edges parallel to the folds, that the guides are located between the film parts folded along the folds and that the edges contact the folds from inside.

26. Device according to claim 25, characterized by the fact that the folds of the two film halves extend at an angle of 45° from outside to the center of the feed.

27. Device according to claim 23, characterized by the fact one guide rail each and one guide each are coupled in such a manner that when the spacing of the guide rails is modified, they are displaceable together with the latter in the same manner.

* * * * *